US005697618A

United States Patent [19]

Schlichting

[11] Patent Number: 5,697,618

[45] Date of Patent: Dec. 16, 1997

[54] METHOD AND EQUIPMENT FOR EFFECTING RANDOM MIXING OF A GROUP OF PEOPLE

[76] Inventor: Paul F. Schlichting, 504 S. Broadway, Redondo Beach, Calif. 90277

[21] Appl. No.: 443,684

[22] Filed: May 18, 1995

[51] Int. Cl.[6] ..... A63F 9/00

[52] U.S. Cl. ..... 273/459; 40/1.5; 40/329; 40/633

[58] Field of Search ..... 273/459, 293, 273/303, DIG. 27; 283/49, 81; 40/1.5, 329, 633

[56] References Cited

U.S. PATENT DOCUMENTS

| | | | |
|---|---|---|---|
| D. 68,685 | 11/1925 | Weinrott et al. | 40/329 X |
| 1,293,137 | 2/1919 | McAdoo | 40/1.5 |
| 1,460,111 | 6/1923 | Panikoff | 40/1.5 |
| 1,608,127 | 11/1926 | Lefebure | 273/303 |
| 2,016,767 | 10/1935 | Bower | 283/49 |
| 2,232,060 | 2/1941 | Foster | 40/1.5 |
| 2,699,553 | 1/1955 | Byers et al. | 40/329 |
| 3,350,799 | 11/1967 | Japs | 40/1.5 X |
| 4,156,539 | 5/1979 | Davidson et al. | 283/81 X |
| 4,244,582 | 1/1981 | Raees et al. | 273/293 |
| 4,352,253 | 10/1982 | Oswalt | 283/81 X |
| 4,733,864 | 3/1988 | Casteel | 273/DIG. 27 X |
| 4,956,931 | 9/1990 | Selke | 40/633 |
| 5,249,808 | 10/1993 | Batté | 273/DIG. 27 X |

FOREIGN PATENT DOCUMENTS

| | | | |
|---|---|---|---|
| 2266242 | 10/1975 | France | 40/633 |
| 1146527 | 3/1969 | United Kingdom | 273/DIG. 27 |

OTHER PUBLICATIONS

Libby products, Pacesetter Catalog For 1973, Dec. 1972 p. 37, Item H.

Sears 1981 Spring/Summer Catalog, Edition 262 A, Dec. 1981, pp. 451, 453, The CAP, NFL Shirts.

*Primary Examiner*—Paul E. Shapiro

*Attorney, Agent, or Firm*—Chernoff, Vilhauer, McClung & Stenzel LLP

[57] ABSTRACT

A method is taught for stimulating mixing at social gatherings. In one form, portable display articles such as name tags that bear one or more indicia or symbol are distributed to the guests. The guests are then given criteria for forming into groups with other guests. The guests move about to compare indicia with other guests, with a view to form groups wherein at least one indicia of each guest in a group relates to at least one indicia of all of the other guests in that group in accordance with the criteria. The process may be periodically repeated to form the guests into a series of different groups. The guests thus get to be in groups with different people, meeting new people and having the opportunity to interact with them. The portable display articles may take a variety of forms such as name tags, bracelets, food or drink containers, clothing such as hats, T-shirts, etc. The indicia may be single or multiple aspect and may be individual, in sets, or in multiple sets.

8 Claims, 2 Drawing Sheets

METHOD AND EQUIPMENT FOR EFFECTING RANDOM MIXING OF A GROUP OF PEOPLE

BACKGROUND OF THE INVENTION

1. Field of the Invention

The invention has to do with a method and equipment for use at a social gathering to cause people to form into groups for interaction and mixing and/or other purposes.

2. The Problem

When hosting a social gathering one is frequently faced with the problem of familiarizing the guests with one another to the point where they feel at ease conversing with new people. When some of the guests already know each other it is all too easy for those with a prior acquaintance to group themselves together. Although this may allow for a quick beginning to the gathering, it tends to defeat another purpose of many gatherings, that of meeting new people.

There are various approaches to livening up such gatherings. Activities such as auctions and raffles are sometimes used, but in general, they do not lead to meeting and interacting with new people.

3. Review of the Prior Art

The prior art in this area appears to be quite thin. A search turned up only three references, none of which appears to be closely related to the invention.

U.S. Pat. No. 4,364,561, granted to Gill and U.S. Pat. No. 4,765,748, granted to Fidalgo are both directed to devices for facilitating somewhat salacious play amongst adolescents or young adults. In Fidalgo, loops must be transferred from hooks on a belt worn by one partner to hooks on a belt worn by another. In Gill, a device worn on the belt buckle of one partner must be used to manipulate a device worn on the belt buckle of another partner. Neither one of these devices encourages intellectual meeting, conversation and interaction in a way comparable to the present invention.

U.S. Pat. No. 3,914,483, granted to Stipek, Jr., is directed to a type of label which may be used as a whole or in die-cut pieces. There is no suggestion of using these labels in the manner of applicant's method.

SUMMARY OF THE DISCLOSURE

The present invention involves a method and equipment for "breaking the ice" at social gatherings. The illustrated method involves distributing a portable display article that bears one or more indicia to each of the guests at a social gathering. Instructions are then given to the guests to allow them to form themselves into groups. The instructions provide criteria or rules. The guests then move about comparing indicia with other guests with a view or intention to forming groups where at least one indicia of each group member relates to at least one indicia of the other group members according to the rules or criteria. Prizes could be offered for success in forming such groups.

The portable display articles may take various forms. The illustrated articles are paper name tags with means such as adhesive on the rear side to releasibly attach to guests' clothing, beverage glass or the like.

The indicia or symbols may be simple single-aspect ones such as a number or a letter. They may be multi-aspect such as geometric shapes that also have different colors. They also may be provided in sets that each comprise a plurality of indicia. Further, there may be multiple sets of indicia on a single display article.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE ILLUSTRATED PREFERRED METHOD AND EQUIPMENT

Figure 1:
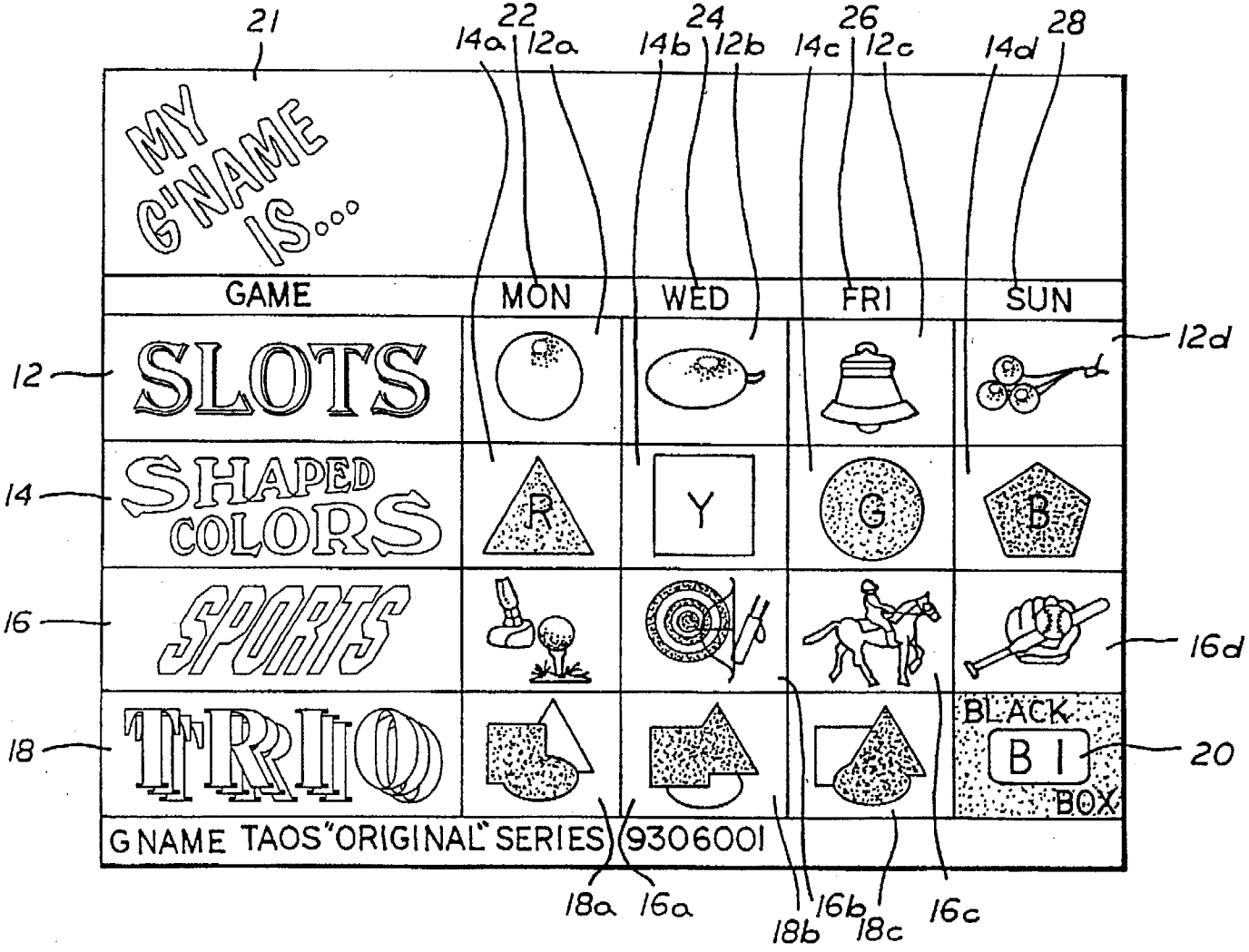
FIG. 1 is a slightly expanded view of a name tag bearing four sets of indicia to be used in a preferred method of the present invention.

FIG. 1 shows a display article in the form of a rectangular paper name tag 10 which may be used in the preferred method for realizing the present invention. This tag has four sets or horizontal rows of indicia locations defined by the grid of lines. These locations bear, symbols or images 12, 14, 16, 18. Each one of these symbols 12, 14, 16, 18 is unique relative to the other systems 12, 14, 16, 18 shown. The first set or row 12 is made up of indicia 12*a*, 12*b*, 12*c*, 12*d*, which are familiar to many as the symbols used in slot machines. On this particular name tag there is shown an orange 12*a*, a plum 12*b*, a bell 12*c* and cherries 12*d*.

The second set or row 14 is made up of indicia in the form of colored shapes. In this instance there is shown a red triangle 14*a*, a yellow square 14*b*, a green circle 14*c* and a blue pentagon 14*d*. These are classic two-aspect indicia, i.e, shape and color.

The third set or row 16 is made up of indicia representing particular sports. In this instance there are shown the indicia or symbols for golf 16*a*, archery 16*b*, horseback riding 16*c* and baseball 16*d*.

The forth set or row 18, dubbed "trio," is made up of multi-aspect indicia which each comprise three different shapes superimposed on one another. The shapes can have different colors to create a great many different possibilities or aspects. In this instance the "trios" shown are 1) a red square on a blue ellipse on a yellow triangle 18*a*; a red triangle on a blue square on a yellow ellipse 18*b* and a blue ellipse on a red triangle on a yellow square 18*c*.

Finally, in the lower right hand corner of the tag 10, is a box 20 with a letter and a number in it. These indicia or symbols may be different colors as for example blue, black or red. This box 20 permits three-aspect matching by letter, number and/or color. An empty box 21 at the top of the tag is provided for the attendee to write his or her name.

Once the name tags 10 have been distributed to the guests, a leader may give instructions that contain rules or criteria for forming groups. The guests then move about comparing tags with one another with a view to forming a group in which at least one of the indicia on the cards of each person in the group are related in accordance with the criteria. Prizes or awards could be given for success in forming groups. One would not always want to simply award prizes for quick formation of one or a few groups, since at times one may prefer that the group forming go forward more slowly so that more of the guests may be included into groups.

More particularly and by way of example, the criteria may call for a group of four in which each guest in the group has a particular "slots" indicia in a different position in the "slots" row, so that together they provided that selected "slots" indicia in the first, second, third and fourth positions of the "slots" row. Thus, a first guest in the group could have that indicia in the first column 22, a second guest could have that indicia in the second column 24, a third guest could have that indicia in the third column 26, and a fourth guest would have that indicia in the fourth column 28.

Simple matching could be done by column. For example, a stated number would form a group in which each guest had a lemon in the first column.

It will be appreciated that "matching" indicia is used herein broadly to include "meeting the criteria" by relating to other indicia in accordance with or as defined by the criteria or rules. Thus, indicia need not be the same as related indicia, and in fact the criteria might be that the indicia of those in the group be related in that they are necessarily different from one another. For example, the criteria could be that each guest have a different indicia in the first column or space of the "slots" row.

Similarly, "rows" need not be horizontal or linear but could be vertical or arranged in an arc.

The "shaped/colors" row or set can be matched or related in much the same way. The difference here, however, is that the matching or relating may be done by color, or shape or the combination shape and color. For example, the leader could call for a group of four in which each person had different color but the same shape in one particular position or column.

In the "sports" row, the matching could be done in a manner similar to the "slots" row.

The "trio" row, however, presents more possibilities. Here matching could be done according to the order of colors, the order of shapes or the order of shapes and colors.

The "black box" 20 in the lower right hand corner allows simple matching by color, letter and/or number. For example, the guests could be told to form a group of some number of people that simply all had the same number (simple, true matching!). They could be told to form into groups of some number that spelled a word with their letters, that created a continuous sequence with their numbers or letters, that had no sequence with their numbers or letters, that had numbers totalling to a given sum, etc.

Preferably, the indicia will be distributed over the various display articles in such a manner that successful grouping using one set or row of indicia will not necessarily create a grouping using a different row or set of indicia. In this way, play may easily switch from one set to another so that different groups can be readily formed for successive instances of play.

It is anticipated that when the instructions are given to begin forming into groups, the guests will begin to move about and compare name tags to determine if they form a match with any of their neighbors. This social activity may be anticipated to lead the various guests to feel more at ease with each other as they exchange words during the matching process. After the matching process, the groups formed by this process might well stay together for a while, allowing the people in the group to get to know one another. A matching exercise could be done every so often so that the various groups could be remixed giving each guest a chance to meet and converse with a new group.

Preferably the display articles are worn or carried so that they are visually accessible to other people. This enables people to move about rather quickly observing the indicia on the display articles of others as they try to assemble into groups.

Figure 2:
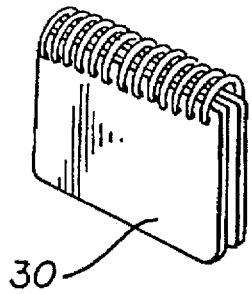
FIG. 2 shows a display article in the form of a name tag with a cover flap.

Alternatively, the display articles could be concealed or hidden, as by virtue of being carried inside people's pockets or purses or they could have their indicia concealed as by having a cover flap as shown in FIG. 2. This would require that people speak to each other to determine each other's indicia. The hidden display articles could then be exposed or shown for purposes of verifying that a group's indicia meet the criteria.

Figure 3:
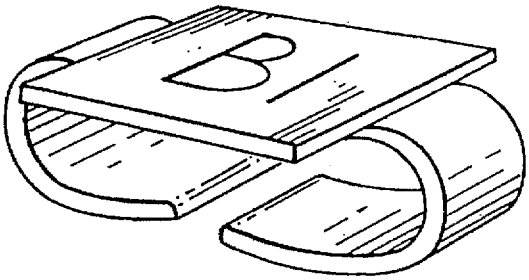
FIG. 3 shows a display article in the form of a wrist band.
Figure 4:
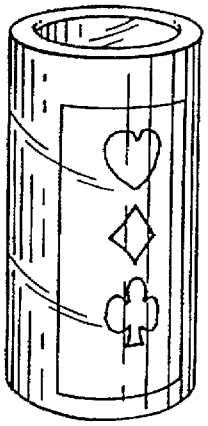
FIG. 4 shows a display article the form of a glass.
Figure 5:
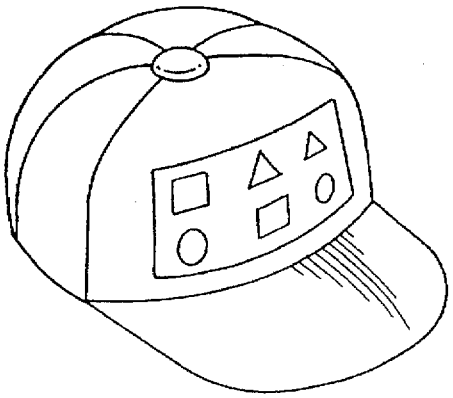
FIG. 5 shows a display article in the form of a cap.
Figure 6:
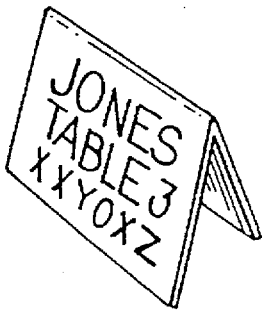
FIG. 6 shows a display article in the form of a table assignment card.

The illustrated name tag 10 may be made of paper, plastic, metal or any other suitable material. Further, the symbols or indicia may be presented in a variety of other ways. For example, they might be in the form of bracelets or caps that the guests might wear (FIGS. 3 and 5). They might be printed on or attachable to beverage glasses or plates that the guests might carry with them around the room (FIG. 4). They might also be provided on dinner table assignment cards that the guests might carry with them (FIG. 6).

The illustrated name tags 10 with multiple horizontal rows of indicia or symbols on them provide a number of opportunities as described above for variety and complexity as to how groups may be informed. Great flexibility is provided for various size and nature of gatherings.

For a more simplified game, as for small groups, the number or letter in the black box could be used.

What is claimed is:

1. Equipment in the form of portable display articles for use in organizing a larger group of people into a series of different smaller subgroups, the organizing involving the steps of providing each person in the larger group with one of the portable display articles and then providing a series of criteria which provide the basis for the people to use indicia on the article to organize into a series of smaller different subgroups, said equipment comprising: a plurality of portable display articles each bearing an identical set of indicia locations, each indicia location bearing an indicium and wherein no particular indicium appears more than once in the same display article, the indicia on each article having different colors and capable of being related to the indicia on other of the display articles in accordance with provided criteria.

2. Equipment in the form of portable display articles for use in organizing a larger group of people into a series of different smaller subgroups, the organizing involving the steps of providing each person in the larger group with one of the portable display articles and then providing a series of criteria which provide the basis for the people to use indicia on the article to organize into a series of smaller different subgroups, said equipment comprising: a plurality of portable display articles each bearing an identical set of indicia locations, each indicia location bearing an indicium and wherein no particular indicium appears more than once in the same display article, the indicia on each article having different orientations and capable of being related to the indicia on other of the display articles in accordance with provided criteria.

3. Equipment in the form of drink containers for use in organizing a larger group of people into a series of different smaller subgroups, the organizing involving the steps of providing each person in the larger group with one of the drink containers and then providing a series of criteria which provide the basis for the people to use indicia on the article to organize into a series of smaller different subgroups, said equipment comprising: a plurality of drink containers each bearing an identical set of indicia locations, each indicia location bearing an indicium and wherein no particular indicium appears more than once in the same display article, the indicia on each drink container capable of being related to the indicia on other of the drink containers in accordance with provided criteria.

4. Equipment in the form of food receptacles for use in organizing a larger group of people into a series of different smaller subgroups, the organizing involving the steps of providing each person in the larger group with one of the food receptacles and then providing a series of criteria which provide the basis for the people to use indicia on the article to organize into a series of smaller different subgroups, said equipment comprising: a plurality of food receptacles each bearing an identical set of indicia locations, each indicia location bearing an indicium and wherein no particular indicium appears more than once in the same display article, the indicia on each food receptacle capable of being related to the indicia on other of the food receptacles in accordance with provided criteria.

5. Equipment in the form of articles of clothing for use in organizing a larger group of people into a series of different smaller subgroups, the organizing involving the steps of providing each person in the larger group with one of the articles of clothing and then providing a series of criteria which provide the basis for the people to use indicia on the article to organize into a series of smaller different subgroups, said equipment comprising: a plurality of articles of clothing each bearing an identical set of indicia locations, each indicia location bearing an indicium and wherein no particular indicium appears more than once in the same display article, the indicia on each article of clothing capable of being related to the indicia on other of the articles of clothing in accordance with provided criteria.

6. Equipment in the form of hats for use in organizing a larger group of people into a series of different smaller subgroups, the organizing involving the steps of providing each person in the lager group with one of the hats and then providing a series of criteria which provide the basis for the people to use indicia on the hat to organize into a series of smaller different subgroups, said equipment comprising: a plurality of hats each bearing an identical set of indicia locations, each indicia location bearing an indicium and wherein no particular indicium appears more than once on the same hat, the indicia on each hat capable of being related to the indicia on other of the hats in accordance with provided criteria.

7. A method for facilitating the interaction of attendees at a gathering, said method comprising:

a) distributing a display article to each one of at least a subset of the attendees, each display article having at least one indicia thereon, b) providing a criteria to the attendees of said subset that provide the basis for the attendees to attempt to form into groups in which at least one indicia of each attendee in the group relates to at least one indicia of the other attendees in the group in accordance with the criteria, c) allowing to the attendees a time period to form into groups, and d) only after the attendees have formed at least one group, providing an additional different criteria for forming groups that will cause the attendees to reform into different groups where the indicia of the members of the group are related in a new way in accordance with the additional different criteria.

8. The method of claim 7, including the following further step:

e) presenting awards to the attendees for successfully forming groups in accordance with the given criteria.

* * * * *